United States Patent [19]

Sharon

[11] 4,114,780

[45] Sep. 19, 1978

[54] COMBINATION INDUSTRIAL RAZOR BLADE DISPENSER AND USED BLADE RECEIVER

[76] Inventor: Shaul Sharon, 935 Bay Dr. #8, Miami Beach, Fla. 33141

[21] Appl. No.: 746,874

[22] Filed: Dec. 2, 1976

[51] Int. Cl.[2] ..... B65D 83/10

[52] U.S. Cl. ..... 221/101; 221/102; 221/185; 206/359

[58] Field of Search ..... 221/102, 185, 199, 97, 221/101; 206/359

[56] References Cited

U.S. PATENT DOCUMENTS

| | | | |
|---|---|---|---|
| 2,641,358 | 6/1953 | Santo | 221/102 X |
| 2,653,379 | 9/1953 | Austin | 221/102 X |
| 3,091,364 | 5/1963 | Ayres | 221/185 X |

FOREIGN PATENT DOCUMENTS

| | | | |
|---|---|---|---|
| 815,829 | 10/1951 | Fed. Rep. of Germany | 221/97 |

*Primary Examiner*—Robert B. Reeves
*Assistant Examiner*—Francis J. Bartuska
*Attorney, Agent, or Firm*—Gustave Miller

[57] ABSTRACT

This device is a container for dispensing new industrial razor blades and for receiving used razor blades for later disposal. It consists principally of a vertical blade compartment. A large stack of new blades may be inserted therein, which has a floating divider for the new blades, used blades being inserted through a slot adjacent the top and adding their weight to the floating divider, thus insuring that the bottom new blade of the stack will be in alignment with a blade dispensing slot in a side wall. A blade ejector is located in a lower subcompartment and has a blade ejecting finger extending up through a slot in the bottom of the blade compartment in a position to be manually operated against the bottom new blade to eject it. At the top, there is a removable roof super compartment having a slit in its top for inserting the corner of a dulled used blade, so it can be manually broken off to provide a new sharp cutting edge. This roof compartment has a laterally slidable floor for cleaning out the broken corners after the roof compartment has been taken off the used blade compartment area. The container has also a belt engaging hooks for hooking the container in vertical position on the clothing of the user, and, in addition, has a pair of angularly upwardly extending blade storing compartments for temporarily placing the blade while the user is otherwise occupied.

8 Claims, 12 Drawing Figures

COMBINATION INDUSTRIAL RAZOR BLADE DISPENSER AND USED BLADE RECEIVER

OBJECTS OF THIS INVENTION

It is the object of this invention to provide a combination new industrial single edge razor blade dispenser and used blade receiver particularly intended for use by paper hangers and others using razor blades, particularly for using industrial single edge blades which are customarily available in 100-blade packages, each blade usually having a cardboard wrapping about the blade portion only.

A further object of this invention is to provide a new blade dispenser and used blade receiver wherein the new blades are located at the bottom of the container, the lowermost blade being readily accessible to a manually operable blade dispenser, and the used blades are inserted into the top of the same container above the new blades.

A further object of this invention is to provide a blade container compartment having new blade dispensing means at the bottom thereof and a used blade receiving slot adjacent its top, the used and new blades being thus contained in the same compartment.

A further object of this invention is to provide a vertically extending blade container having clothing engaging hooks for supporting the container in vertical position.

A further object of this invention is to provide a vertically extending container single compartment for new and used blades therein, the new blades having a blade ejector plunger at its bottom and a used blade slot at its top end, so that, as new blades are used up at the bottom, space is created at the top for accepting used blades through a used blade receiving slot at the top.

Still, a further object of this invention is to provide a new blade dispenser and used blade receiver container having a temporary blade holding means on an outside wall thereof.

A further object of this invention is to provide a new and used blade compartment which may be made in either of two forms, wherein in one form the new blade is yieldably pushed down to blade ejecting position and in another form, where the weight of the blades serves to urge the bottom new blade to blade ejecting position.

A further object of this invention is to provide a device for manually breaking off the corners of used blades to provide new sharp corners.

Yet a further object of this invention is to provide a temporary blade holder on an outside wall of the container.

Still another object of this invention is to provide one form of this invention wherein a new and used blade divider has a depending spring for pressuring the new blades therebelow to move the bottommost blade to blade ejecting position, and in the other form, wherein the weight of the used and new blades moves the bottom new blade to blade ejecting position.

A still further object of this invention is to provide manually operable means extending outside the container for manually urging the blades downwardly, to move the bottom blade to blade ejecting position.

A further object of this invention is to provide a clothing supported single compartment for new and used blades having a clothing engaging means for holding the compartment verticle that is an improvement over the prior art, such as in U.S. Pat. No. 1,397,232, and wherein the blade holder and dispenser is an improvement over the prior art, such as in U.S. Pat. Nos. 2,451,382; 2,653,704; 2,684,151; 3,180,484.

BRIEF DESCRIPTION OF THE FIGURES

With the above and other related objects in view, this invention consists in the details of construction and combination of parts as will be more fully understood from the following description when read in conjunction with the accompanying drawings, in which.

DETAILED DESCRIPTION OF THE INVENTION

Figure 1:
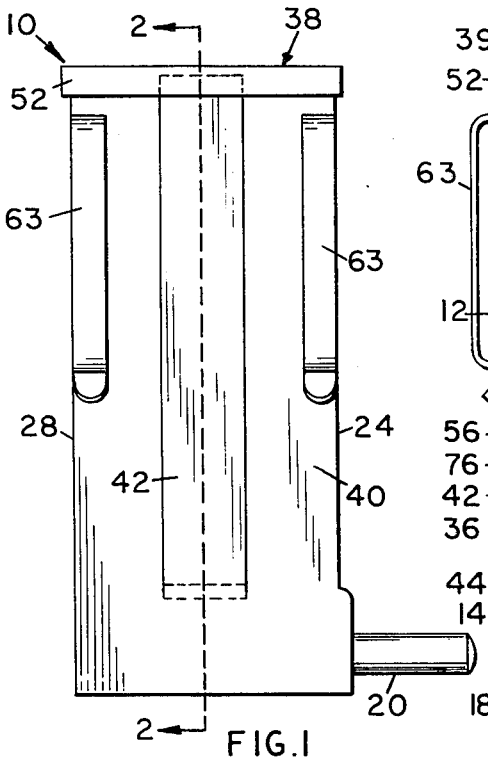
FIG. 1 is a back elevation of the new and used blade holder and dispenser of this invention.

There is shown at 10 one form of the single compartment new and used blade holder and new blade dispenser container of this invention. This holder and dispenser container 10 consists of a single new and used blade compartment 12 having a floor 14 provided with a slot 16 extending part way across. A subcompartment 18 extending below the floor 14 has a manually pushable plunger 20 extending through one side wall 22 displaced outwardly from a compartment side wall 24 a distance at least equal to the thickness of a pusher finger 26. The finger 26 extends upwardly not more than the thickness of a new blade 36 resting on floor 14, so that the finger 26 may come to rest behind the end of the bottom new blade 36 in compartment 12.

The opposite side wall 28 has a blade ejecting slot 30 adjacent the floor 14 of a height to permit only the bottom new blade 36 to be ejected therethrough. The manually pushable plunger 20 extending through subcompartment displaced side wall 26 has secured thereto a rod 32 extendable through a suitable opening in opposite side wall 28 against a compression spring 34 coiled thereabout. Manually pushing in the plunger 20 causes the blade pusher finger 26 to eject the bottom new blade 36 through side wall slot 30, and, when released, the spring 34 restores plunger 20 into a position placing the finger 26 behind the end of the newly positioned bottom blade.

Figure 2:
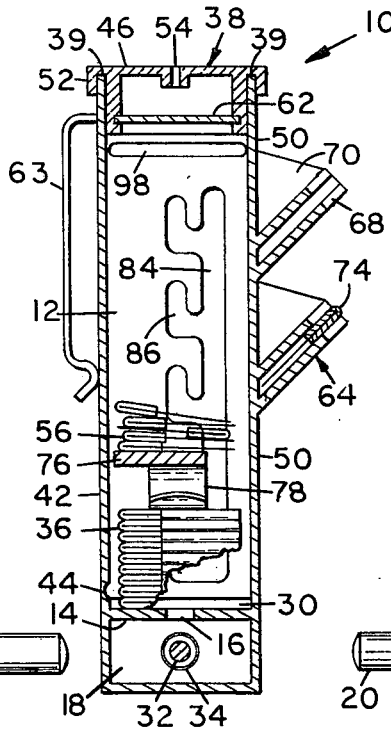
FIG. 2 is a verticle section view on line 2—2 of FIG. 1.
Figure 3:
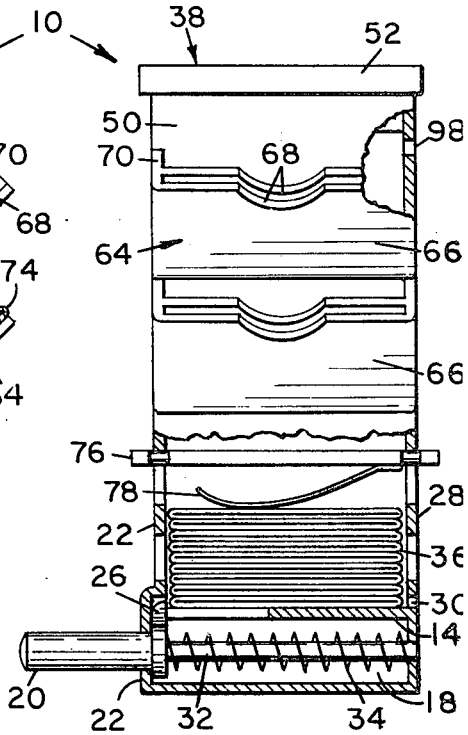
FIG. 3 is a front elevation, partly in section.
Figure 4:
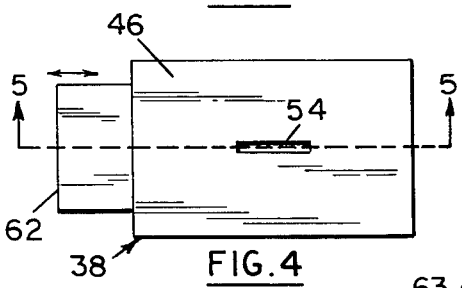
FIG. 4 is a top elevation.
Figure 6:
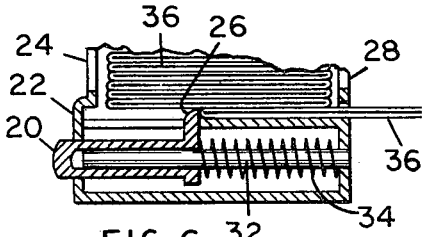
FIG. 6 is a section showing the new blade ejector in ejecting position.
Figure 5:
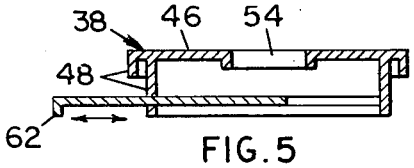
FIG. 5 is a verticle section on line 5—5 of FIG. 4, showing the ceiling member.

To insert a new stack of new blades 36 in compartment 12, a supercompartment ceiling member 38 is lifted off the top edges 39 of blade compartment 12, and the stack of new blades 26 is placed down through the open top. The back wall 40 of compartment 12 is provided with a door 42 through which one's fingers may be inserted, if needed, in positioning the stack of new blades 36 therein on the bottom floor 14. The door 42 is hinged by thinned portion 44 of the back wall 40. The ceiling member 38, shown in section in FIG. 2 and separately in FIGS. 4 and 5, has a top surface roof member 46 connected to depending side and end walls 48 which fit into and extend within the top edge 38 of the compartment side walls 24, 28, the back wall 40 and the front wall 50. Also depending from roof member 46 are outside flanges 52 which depend outside the top edge 39 at the four compartment walls, and also about the top edges of the closed compartment door 42, as shown in FIGS. 2 and 3.

Extending through the ceiling roof 46 is a reinforced slit 54 into which a dulled corner of a used blade 56 may be inserted and manually broken off at 58 to provide a new sharp cutting corner 60, the broken corner dropping into the supercompartment 38 and accumulating on the trap floor 62, which may be opened from time to time, when removed from the compartment 12, to dispose of the broken corners safely.

The entire container 10 is made of comparatively rigid plastic or other suitable material, and is held in upright position in use by a pair of clothing hooks 63, extending from back wall 40 on opposite sides of door 42. Extending angularly and upwardly from front wall 50, at possibly about a 45° angle, are a pair of temporary blade holders 64.

Each of these temporary blade holders 64 consits of a pair angularly extending parallel walls 66 spaced apart slightly more than the thickness of the razor blade 56 but less than the thickness of the blade handle 74. Finger notches 68 are provided to facilitate grasping the blade handle 74 to remove the used blade 56 when desired. Side webs 70 reinforce and support the walls 66 at the desired angle.

The new blades 36 in industrial packages come wrapped about the blade portion only by a piece of cardboard 72, of a thickness to make the thickness of the blade 36 and warpping 72 substantially equal to that of the blade handle 74. Thus, the stack of new blades 36 remains flat in blade compartment 12.

The description thus far applies equally to both forms of the invention. In the form of FIGS. 1, 2 and 3, a divider 76 is placed in the compartment 12 between the new blades 36 and the used blades 56. This divider 76 has a depending spring 78 on its bottom and has finger manipulatable protusions 80 connected thereto by necks 82.

The opposite side walls 24 and 28 are each provided with aligned vertical slots 84 to one side of the vertical center of the side walls 24 and 28 and connected to each of the slots 84 are a plurality of vertically spaced inwardly, upwardly extending slot portions 86, extending vertically at the vertical center of the side walls 24 and 28. It will be noted that the divider 76 is not symmetrical; it does not extend the width of the compartment 12. This permits the divider 76 to be inserted in vertical position and then turned to horizontal position. When the new blades 36 have been used up enough so that the spring 78 no longer bears against the top new blade, then the divider handles 80 are moved sideways to then move the necks 82 down the vertical slot 84 to the next lower slot 86 and pushed in and then raised up by the spring pressure against the top new blade 36, and this procedure is repeated as needed. Inasmuch as the divider 76 remains horizontal at all times once it is inserted, it is easily possible to move it as necessary as it continues to support the used blades thereabove.

Figure 11:
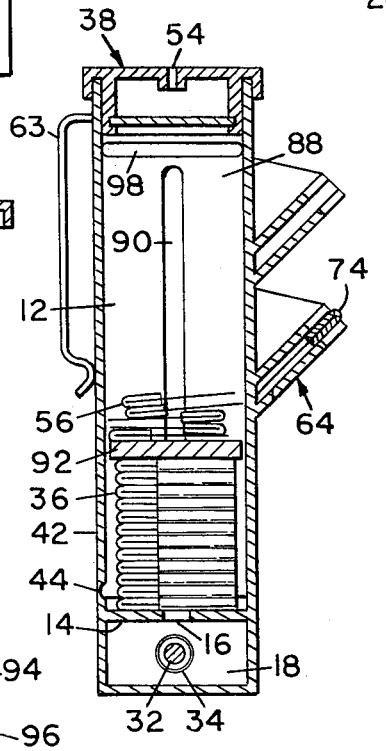
FIG. 11 is a vertical section, similar to FIG. 2, of a simplified form of this invention.
Figure 7:
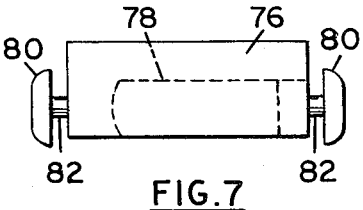
FIG. 7 is an elevational view of the blade compartment divider member of FIG. 2.
Figure 10:
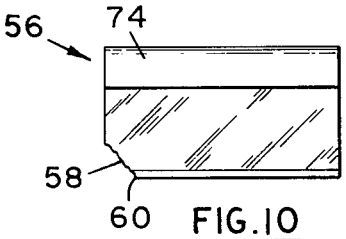
FIG. 10 shows a used blade wherein a corner has been broken as in this invention to provide a new sharp corner to extend the life of the used blade.
Figure 8:
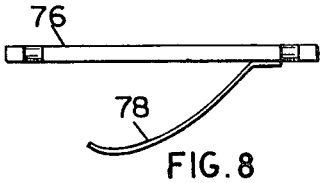
FIG. 8 is a horizontal edge view of FIG. 7.
Figure 12:
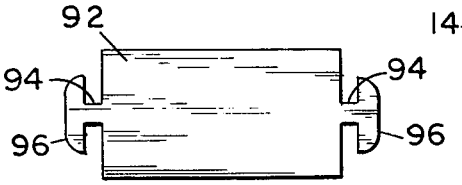
FIG. 12 is an elevation of the blade divider member of FIG. 11.
Figure 9:
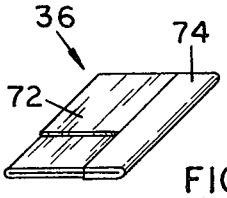
FIG. 9 is a perspective view of an industrial single edge blade showing that only the blade portion, and not the handle, is wrapped.

In the form of the invention shown in FIGS. 11 and 12, the side walls 88 have centrally aligned vertical slots 90, the divider member 92 extends substantially the full width of the compartment, and has necks 94 connecting to finger manipulatable protusions 96. In this case, the divider 92 may be turned to vertical position, slid in through the vertical slots 90 and then turned to horizontal position. The weight of the used blades normally presses the stack of new blades 34 downwardly so as to place the bottom blade 36 in blade ejecting position. If necessary, of course, the protrusions 96 may be manually manipulated to press the divider 92 downwardly to press the new blades 36 down and assure the bottommost new blade 36 is in blade ejecting position.

OPERATION OF THE INVENTION

The operation of the invention is believed obvious from the above description. To load the container compartment 12, the supercompartment ceiling member 38 is lifted off, releasing the door 42 to move forward. A stack of new blades 36 is inserted, the used blades 56 of course being first dropped out from the up-ended container 10. By inserting one's finger through to door opening, the new blade stack can be straightened if needed. Then, after first emptying the supercompartment 36 of any broken blade corners, by opening its sliding door 62, the ceiling member 38 is placed back in position, holding the door 42 in closed position, as shown in FIG. 2. When a new blade 36 is needed, the plunger 20 is pushed to eject a blade 36 through ejector slot 30, and it is unwrapped and used, being stored in a holder 64 between uses.

When both corner points 58 become dulled, they are broken off at 58, in the roof slit 54, thereby providing new sharp corners 60. This may be repeated as often as possible until the entire used blade 56 is dulled, then it is inserted through the used blade slot 98 into the top of the compartment 12 to drop down on the divider of the previously inserted used blades. If the bottom blade 36 does not fall to ejecting position, the divider is manipulated by its protusions to push the new blades downwardly to press the bottom blade 36 to ejecting position.

ABSTRACT OF THE DRAWING

In the drawing, like numbers refer to like parts, and for the purposes of explication, set forth below are the numbered parts of the improved COMBINATION INDUSTRIAL RAZOR BLADE DISPENSER AND USED BLADE RECEIVER of this invention.

10 single compartment new and used blade container of this invention
12 single blade compartment
14 compartment floor
16 pusher finger slot in floor 14
18 ejector subcompartment
20 manually pushable ejector plunger
22 outwardly displaced wall of 18 from wall 24
24 compartment wall just above 22
26 pusher or ejector finger
28 wall of 14 opposite from 24
30 blade ejecting slot in wall 28
32 ejector rod
34 spring on 32
36 new blades
38 supercompartment ceiling member
39 top edges of 12

40 back wall of 12
42 door to 12 in 40
44 door hinge
46 roof member of 38
48 depending walls of 46
50 front wall of 12
52 outside depending flanges of 46
54 used blade corner breaking reinforced slit
56 used blade
58 broken off corner of 56
60 new sharp cutting corner of 56
62 trap door of 38
63 clothing engaging hooks
64 temporary blade holders
66 angular upward walls of 64
68 finger notches in 66
70 side webbs of 64
72 wrapping on 36
74 blade handle
76 divider having depending spring 78
78 depending spring on 76
80 finger manipulatable protusions on 76
82 neck connecting 80 to 76
84 vertical offset aligned slots in walls 24 and 28
86 inward and upward slot portions
88 side walls in FIG. 11
90 vertical center slots in 88
92 divider member in FIG. 11
94 necks on 92
96 protusions on 92
98 used blade slot in 10

While the device has been shown and the structure described in detail, it is obvious that this invention is not to be considered as being limited to the exact form disclosed and changes in detail and construction may be made therein within the scope of what is claimed, without departing from the spirit of this invention.

Having thus set forth the nature of this invention, what is claimed is:

1. A combination industrial single edge razor blade dispenser and used blade receiver comprising a boxlike vertical container (10) of comparatively rigid material having a vertical blade container single compartment (12), a blade supporting floor (14) at the bottom of said compartment (12) to receive and support a stack of blades (36) thereon, a new blade ejecting slot (30) in one side wall (28) of said compartment (12) adjacent said bottom blade supporting floor (14) thereof, a subcompartment (18) beneath said blade supporting floor (14), a manually operable spring (34) resisted plunger (20) in said subcompartment (18), a blade ejector finger (26) mounted on said plunger (20) and extending up through a slot (16) in said blade supporting floor (14) and normally located against the end of the bottom blade (36) remote from said blade ejecting slot (34) on said blade compartment floor (14), a used blade inserting slot (98) in said blade receiving compartment (12) adjacent the top thereof for receiving used blades (56) in said container (10) as new blades (36) are used up, means (63) for maintaining said blade container (10) in vertical position in operative use, said vertical maintaining means comprising clothing attaching means (63) on an exterior wall (40) of said container for holding said container (10) in verticle position on the clothing of a user, and aligned slot means (84 or 90) in two opposite walls (24, 28 or 88) of said container (10), a new blade and used blade divider (76 or 92) in said compartment (12), said divider having manually manipulatable protrusions (80 or 96) extending through said opposite aligned positioning slots (84 or 90) for positioning said blade divider in said compartment (12).

2. The combination of claim 1, a removable blade compartment supercompartment ceiling member (38) having a used blade corner receiving slit (54), in the top thereof, for manually breaking off a used blade corner (58) to provide a newly available sharp corner (60), and a removable floor (62) in said supercompartment (38) for emptying the broken corners from said supercompartment (38).

3. The combination of claim 1, said aligned slots having a plurality of aligned notches (86) inwardly and upwardly therefrom, and a yieldable spring means (78) depending from said divider (76) for pressuring the new blades (36) downwardly therebelow.

4. The combination of claim 1, said verticle maintaining means comprising a pair of transversely spaced apart downwardly extending clothing engaging hook members (63), and a bottom hinged (44) door (42) located between said hook members (63) providing manual access therethrough.

5. The combination of claim 1, and temporary blade holding means (64) on the exterior of said container (10) comprising a pair of parallel angularly, upwardly extending walls (66) spaced apart a distance greater than the thickness of a single edge blade (50) and less than the thickness of the handle (74) of the single edge blade.

6. The combination of claim 5, said parallel spaced apart walls (66) having finger notches (68) intermediate their ends (70).

7. The combination of claim 4, and a removable ceiling member (38) on said blade compartment (12) having downwardly extending walls (48) and flanges (52) spaced apart the thickness of the compartment walls (24, 28, 40, 50) to hold said door (42) in closed position.

8. The combination of claim 1, and temporary blade holding means (64) on the exterior of said container (10) comprising a shelf extending angularly and upwardly therefrom.

* * * * *